US011621497B2

(12) United States Patent
Zhang

(10) Patent No.: US 11,621,497 B2
(45) Date of Patent: Apr. 4, 2023

(54) ANTENNA ASSEMBLY FOR A BEAMFORMING ANTENNA AND BASE STATION ANTENNA

(71) Applicant: CommScope Technologies LLC, Hickory, NC (US)

(72) Inventor: Xun Zhang, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/554,258

(22) Filed: Dec. 17, 2021

(65) Prior Publication Data

US 2022/0109248 A1 Apr. 7, 2022

Related U.S. Application Data

(63) Continuation of application No. 17/072,214, filed on Oct. 16, 2020, now Pat. No. 11,233,338.

(30) Foreign Application Priority Data

Nov. 6, 2019 (CN) ..... 201911073578.9

(51) Int. Cl.

| | |
|---|---|
| ***H01Q 21/00*** | (2006.01) |
| ***H01Q 21/06*** | (2006.01) |
| ***H01Q 1/24*** | (2006.01) |
| ***H01Q 19/10*** | (2006.01) |
| ***H01Q 21/26*** | (2006.01) |
| *H01Q 19/06* | (2006.01) |

(52) U.S. Cl.

CPC ..... *H01Q 21/061* (2013.01); *H01Q 1/246* (2013.01); *H01Q 19/10* (2013.01); *H01Q 21/26* (2013.01); *H01Q 19/06* (2013.01); *H01Q 21/0031* (2013.01)

(58) Field of Classification Search

CPC ..... H01Q 21/061; H01Q 1/246; H01Q 19/10; H01Q 21/26; H01Q 21/0031; H01Q 19/06

See application file for complete search history.

(56) References Cited

U.S. PATENT DOCUMENTS

2018/0131078 A1* 5/2018 Shooshtari ..... H01Q 19/06

* cited by examiner

*Primary Examiner* — Joseph J Lauture
(74) *Attorney, Agent, or Firm* — Myers Bigel, P.A.

(57) ABSTRACT

The present invention relates to an antenna assembly for a beamforming antenna, comprising a reflector and an antenna array that includes a plurality of first radiating elements that are arranged as a first vertically extending array, the first radiating elements extending forwardly from the reflector; and a plurality of second radiating elements that are arranged as a second vertically extending array, the second radiating elements extending forwardly from the reflector. Two adjacent first radiating elements are spaced apart from one another by a first distance, and a first radiating element and an adjacent second radiating element are spaced apart from one another by a second distance. The first distance is substantially equal to the second distance. The antenna assembly further comprises a plurality of parasitic elements that are placed along sides of the first and second of the vertically extending arrays.

19 Claims, 5 Drawing Sheets

ANTENNA ASSEMBLY FOR A BEAMFORMING ANTENNA AND BASE STATION ANTENNA

RELATED APPLICATIONS

The present application is a continuation application of U.S. patent application Ser. No. 17/072,214, filed Oct. 16, 2020, which claims priority to and the benefit of Chinese Patent Application Serial No. 201911073578.9, filed Nov. 6, 2019, the content of which is hereby incorporated herein in its entirety.

FIELD OF THE INVENTION

The present invention generally relates to radio communications and, more particularly, to antenna assemblies for a beamforming antenna and base station antennas for cellular communications systems.

BACKGROUND

Cellular communications systems are well known in the art. In a cellular communications system, a geographic area is divided into a series of regions that are referred to as "cells" which are served by respective base stations. The base station may include one or more base station antennas that are configured to provide two-way radio frequency ("RF") communications with mobile subscribers that are within the cell served by the base station.

In many cases, each base station is divided into "sectors." In perhaps the most common configuration, a hexagonally shaped cell is divided into three 120° sectors, and each sector is served by one or more base station antennas that have an azimuth Half Power Beam width (HPBW) of approximately 65°. Typically, the base station antennas are mounted on a tower structure, with the radiation patterns (also referred to herein as "antenna beams") that are generated by the base station antennas directed outwardly. Base station antennas are often implemented as linear or planar phased arrays of radiating elements.

Base station antennas often include a linear array or a two-dimensional array of radiating elements, such as crossed dipole or patch radiating elements. In order to increase system capacity, beamforming base station antennas are now being deployed that include multiple closely-spaced linear arrays of radiating elements that are configured for beamforming. A typical objective with such beamforming antennas is to generate an antenna beam that has a narrowed beamwidth in the azimuth plane. This increases the power of the signal transmitted in the direction of a desired user and reduces interference.

If the linear arrays of radiating elements in a beamforming antenna are closely spaced together, it may be possible to scan the antenna beam to very wide angles in the azimuth plane (e.g., azimuth scanning angles of 60°) without generating significant grating lobes. However, as the linear arrays are spaced more closely together, mutual coupling increases between the radiating elements in adjacent linear arrays, which degrades other performance parameters of the base station antenna such as the co-polarization performance. Therefore, the radiation pattern of the antenna may be distorted and the beamforming performance may be degraded. This is undesirable.

SUMMARY

Embodiments of the present invention provide an antenna assembly for a beamforming antenna and a related base station antenna capable of overcoming at least one drawback in the prior art.

According to a first aspect of the present invention, there is provided an antenna assembly for a beamforming antenna that includes a reflector and an antenna array that has a plurality of vertically extending arrays. The plurality of vertically extending arrays include a plurality of first radiating elements that are arranged as a first of the vertically extending arrays, the first radiating elements extending forwardly from the reflector; and a plurality of second radiating elements that are arranged as a second of the vertically extending arrays, the second radiating elements extending forwardly from the reflector. The first and second of the vertically extending arrays are adjacent each other in a horizontal direction, two adjacent first radiating elements are spaced apart from one another by a first distance, and a first radiating element and an adjacent second radiating element are spaced apart from one another by a second distance. The first distance is substantially equal to the second distance. The antenna assembly further includes a plurality of parasitic elements for the antenna array. The parasitic elements are placed along sides of the first and second of the vertically extending arrays, between adjacent ones of the first radiating elements and between adjacent ones of the second radiating elements. A first of the parasitic elements extends farther forwardly from the reflector than a second of the parasitic elements, and the first of the parasitic elements is closer to a middle of the antenna array than the second of the parasitic elements.

With the antenna assembly in accordance with some embodiments of the present invention, the shape of the radiation pattern and/or the CPR performance of the antenna may also be improved.

In some embodiments, the parasitic elements can be mounted at three or more different distances forwardly of the reflector. At least some of the parasitic elements that are in between the first and second of the vertically extending arrays are mounted farther from the reflector than are at least some of the parasitic elements that are not between the first and second of the vertically extending arrays.

In some embodiments, the parasitic elements can be stepped down one or more times from a middle region of the antenna array towards an outer region of the antenna arrays in a vertical direction and/or a horizontal direction.

In some embodiments, the second radiating elements can be staggered in a vertical direction with respect to the first radiating elements.

In some embodiments, ones of the parasitic elements can be provided around each first radiating element and around each second radiating element.

In some embodiments, the parasitic elements can include a plurality of first parasitic elements that extend vertically, the first parasitic elements can be disposed on both sides of each first radiating element in the horizontal direction and on both sides of each second radiating element in the horizontal direction.

In some embodiments, distances that the first parasitic elements are located forwardly of the reflector can be defined according to the intensities of coupling interference in respective locations where the first parasitic elements are located.

In some embodiments, distances that the first parasitic elements are located forwardly of the reflector can be stepped down one or more times from the middle of the antenna array towards the outer regions of the antenna array.

In some embodiments, the parasitic elements can include a plurality of second parasitic elements that extend horizontally. The second parasitic elements can be disposed on both sides of each first radiating element in a vertical direction and on both sides of each second radiating element in the vertical direction.

In some embodiments, distances that the second parasitic element are located in front of the reflector can be defined according to the intensities of coupling interference in respective locations where the second parasitic elements are located.

In some embodiments, distances that the second parasitic elements are located in front of the reflector can be stepped down one or more times from the middle of the antenna array towards the outer regions of the antenna array.

In some embodiments, the plurality of vertically extending arrays can further include: a plurality of third radiating elements that are arranged as a third of the vertically extending arrays. The first of the vertically extending arrays, the second of the vertically extending arrays, and the third of the vertically extending arrays can be sequentially arranged in the horizontal direction. Arranged about a first of the second radiating elements, a substantially regular hexagonal shape can be collectively defined by two of the first radiating elements that are adjacent the first of the second radiating elements, two of the second radiating elements that are adjacent the first of the second radiating elements, and two of the third radiating elements that are adjacent the first of the second radiating elements.

According to another aspect of the present invention, there is provided an antenna assembly for a beamforming antenna that includes a reflector and an antenna array that includes a plurality of vertically extending arrays. The plurality of vertically extending arrays can have: a plurality of first radiating elements that are arranged as a first of the vertically extending arrays, the first radiating elements extending forwardly from the reflector; and a plurality of second radiating elements that are arranged as a second of the vertically extending arrays, the second radiating elements extending forwardly from the reflector. The first and second of the vertically extending arrays are adjacent each other in a horizontal direction. An average value of spacing between adjacent first radiating elements is a first average spacing, and an average value of spacing between a first radiating element and an adjacent second radiating element is a second average spacing. The absolute value of the difference between the first average spacing minus the second average spacing is less than 10% of the first or second average spacing. The antenna assembly further includes a plurality of parasitic elements for the antenna arrays. The parasitic elements are placed along sides of the first and second of the vertically extending arrays, between adjacent ones of the first radiating elements, and between adjacent ones of the second radiating elements. Distances that the parasitic elements extend forwardly from the reflector are stepped down one or more times from the middle region towards the outer region of the antenna array in a vertical direction and/or a horizontal direction.

In some embodiments, the absolute value of the difference between the first average spacing minus the second average spacing can be less than 5% of the first or second average spacing.

In some embodiments, the first average spacing can be substantially equal to the second average spacing.

In some embodiments, the second radiating elements can be staggered in a vertical direction with respect to the first radiating elements.

In some embodiments, parasitic elements can be provided about each first radiating element and around each second radiating element.

In some embodiments, the parasitic elements can further include a plurality of first vertically extending parasitic elements, the first parasitic elements being disposed on both sides of each of the first radiating elements and on both sides of each of the second radiating elements in the horizontal direction.

In some embodiments, the parasitic elements can further include a plurality of second horizontally extending parasitic elements, the second parasitic elements being disposed on both sides of each of the first radiating elements and on both sides of each of the second radiating elements in a vertical direction.

According to yet other aspects of the present invention, a base station antenna includes an antenna assembly according to any embodiments of present invention.

According to another aspect of the present invention, a base station antenna is provided that includes a beamforming array with a reflector, an antenna array that has a plurality of columns of radiating elements that extend forwardly from the reflector, and a plurality of first parasitic elements and a plurality of second parasitic elements. The first parasitic elements are arranged as a plurality of columns of first parasitic elements that are positioned between respective pairs of adjacent columns of radiating elements and outside end ones of the columns of radiating elements. At least some of the first parasitic elements that are positioned between a first pair of adjacent columns of radiating elements are located farther forwardly from the reflector than are the first parasitic elements that are outside the end columns of radiating elements.

In some embodiments, the first parasitic elements that extend the farthest forwardly from the reflector can be included in a middle one of the plurality of columns of first parasitic elements.

In some embodiments, the second parasitic elements can be arranged as a plurality of rows of second parasitic, wherein at least some of the second parasitic elements that are positioned in a middle region of the antenna are located farther forwardly from the reflector than are other of the second parasitic elements that are positioned at a periphery of the antenna array.

DETAILED DESCRIPTION

Figure 1:
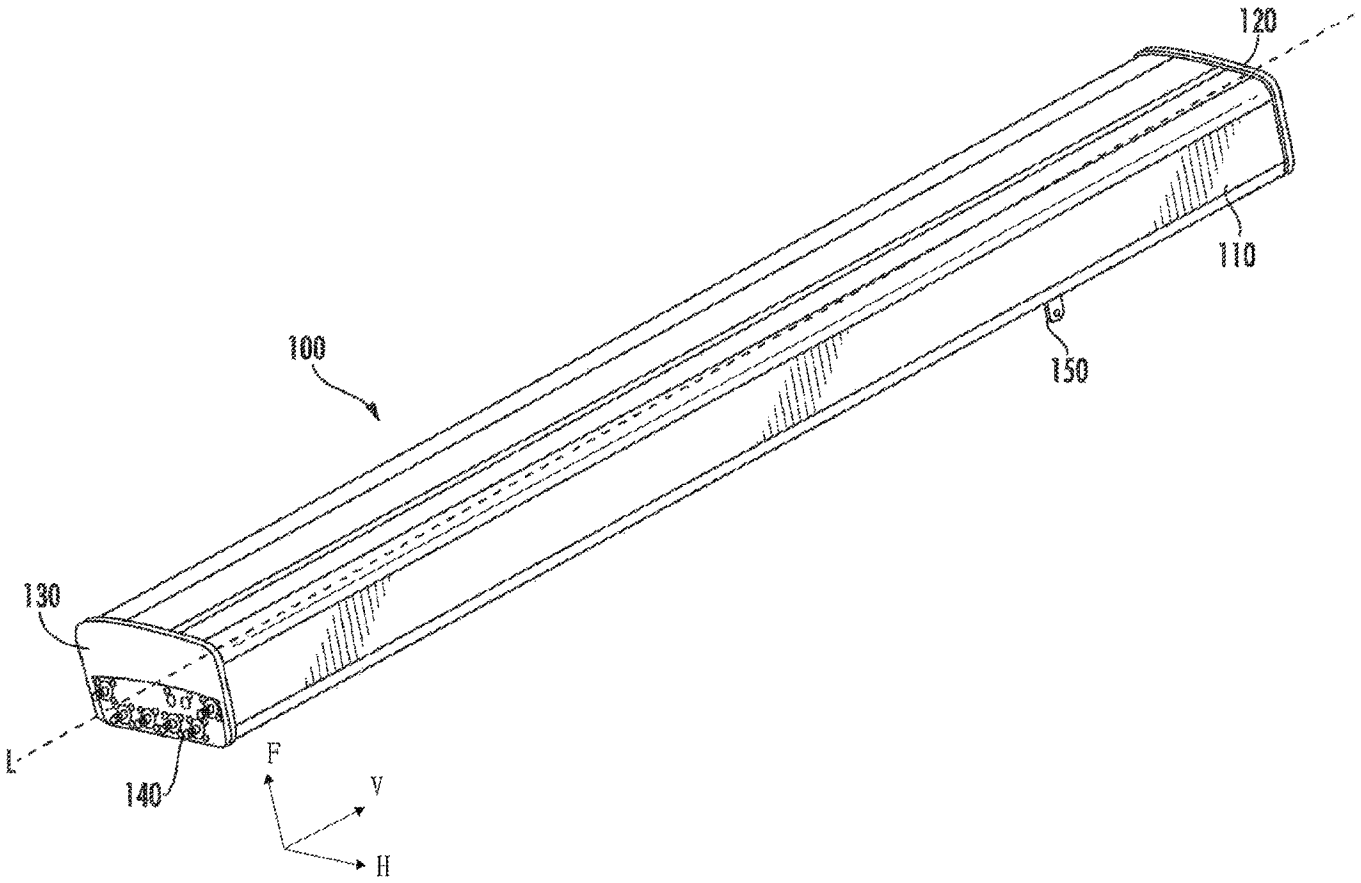
FIG. 1 is a schematic perspective view of a base station antenna according to some embodiments of the present invention.

The present invention will be described below with reference to the drawings, in which several embodiments of the present invention are shown. It should be understood, however, that the present disclosure may be implemented in many different ways, and is not limited to the example embodiments described below. In fact, the embodiments described hereinafter are intended to make a more complete disclosure of the present disclosure and to adequately explain the scope of the present disclosure to a person skilled in the art. It should also be understood that the embodiments disclosed herein can be combined in various ways to provide many additional embodiments.

In the drawings, the same reference signs present the same elements. In the drawings, for the sake of clarity, the sizes of certain features may be modified.

It should be understood that, the wording in the specification is only used for describing particular embodiments and is not intended to limit the present invention. All the terms used in the specification (including technical and scientific terms) have the meanings as normally understood by a person skilled in the art, unless otherwise defined. For the sake of conciseness and/or clarity, well-known functions or constructions may not be described in detail.

The singular forms "a/an" and "the" as used in the specification, unless clearly indicated, all contain the plural forms. The words "comprising", "containing" and "including" used in the specification indicate the presence of the claimed features, but do not preclude the presence of one or more additional features. The wording "and/or" as used in the specification includes any and all combinations of one or more of the items listed. The phases "between X and Y" and "between about X and Y" as used in the specification should be construed as including X and Y. As used herein, phrases such as "between about X and Y" mean "between about X and about Y". As used herein, phrases such as "from about X to Y" mean "from about X to about Y."

In the specification, when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being "directly on", "directly attached" to, "directly connected" to, "directly coupled" with or "directly contacting" another element, there are no intervening elements present. In the specification, references to a feature that is disposed "adjacent" another feature may have portions that overlap, overlie or underlie the adjacent feature.

In the specification, words describing spatial relationships such as "up", "down", "left", "right", "forth", "back", "high", "low" and the like may describe a relation of one feature to another feature in the drawings. It should be understood that these terms also encompass different orientations of the apparatus in use or operation, in addition to encompassing the orientations shown in the drawings. For example, when the apparatus shown in the drawings is turned over, the features previously described as being "below" other features may be described to be "above" other features at this time. The apparatus may also be otherwise oriented (rotated 90 degrees or at other orientations) and the relative spatial relationships will be correspondingly altered.

The antenna assemblies according to embodiments of the present invention are applicable to various types of base station antennas, and may be particularly suitable for beamforming antennas.

As the number of arrays of radiating elements mounted on a reflector of a base station antenna increases, the spacing between radiating elements of different arrays is typically decreased, which results in increased coupling interference between the arrays. This increased coupling interference may distort the radiation pattern of the antenna, which may degrade the antennas the beamforming performance. The coupling interference between the arrays may affect the radiation pattern in both the azimuth and elevation planes. Excessive coupling may affect not only the gain (due to coupling loss), but also distort the shape of the radiation pattern and/or degrade the cross-polarization discrimination (CPR) performance of the antenna.

Pursuant to embodiments of the present invention, techniques are provided for creating a symmetrical, balanced electromagnetic environment in the vicinity of the linear arrays of a base station antenna in which there is with low coupling between closely spaced radiating elements. This symmetrical, balanced electromagnetic environment may exhibit balanced, symmetrical coupling in the far field and low coupling levels in the near field. Since the coupling interference between radiating elements is symmetrical and/or balanced, distortion of the radiation pattern may be reduced, which may improve the CPR performance of the antenna. Further, according to some embodiments of the present invention, the RF energy couples from a first radiating element to a parasitic element before potentially coupling to a second radiating element and that therefore there is a longer transmission path between the first and second radiating elements, and that therefore there is a longer transmission path between the first and second radiating, thereby reducing near field coupling between adjacent radiating elements. With the antenna assembly in accordance with some embodiments of the present invention, the coupling interference between adjacent linear arrays may be reduced, thus improving the isolation performance. Further, with the antenna assembly in accordance with some embodiments of the present invention, the shape of the radiation pattern and/or the CPR performance of the antenna may also be improved.

Embodiments of the present invention will now be described in more detail with reference to the accompanying drawings.

Figure 2:
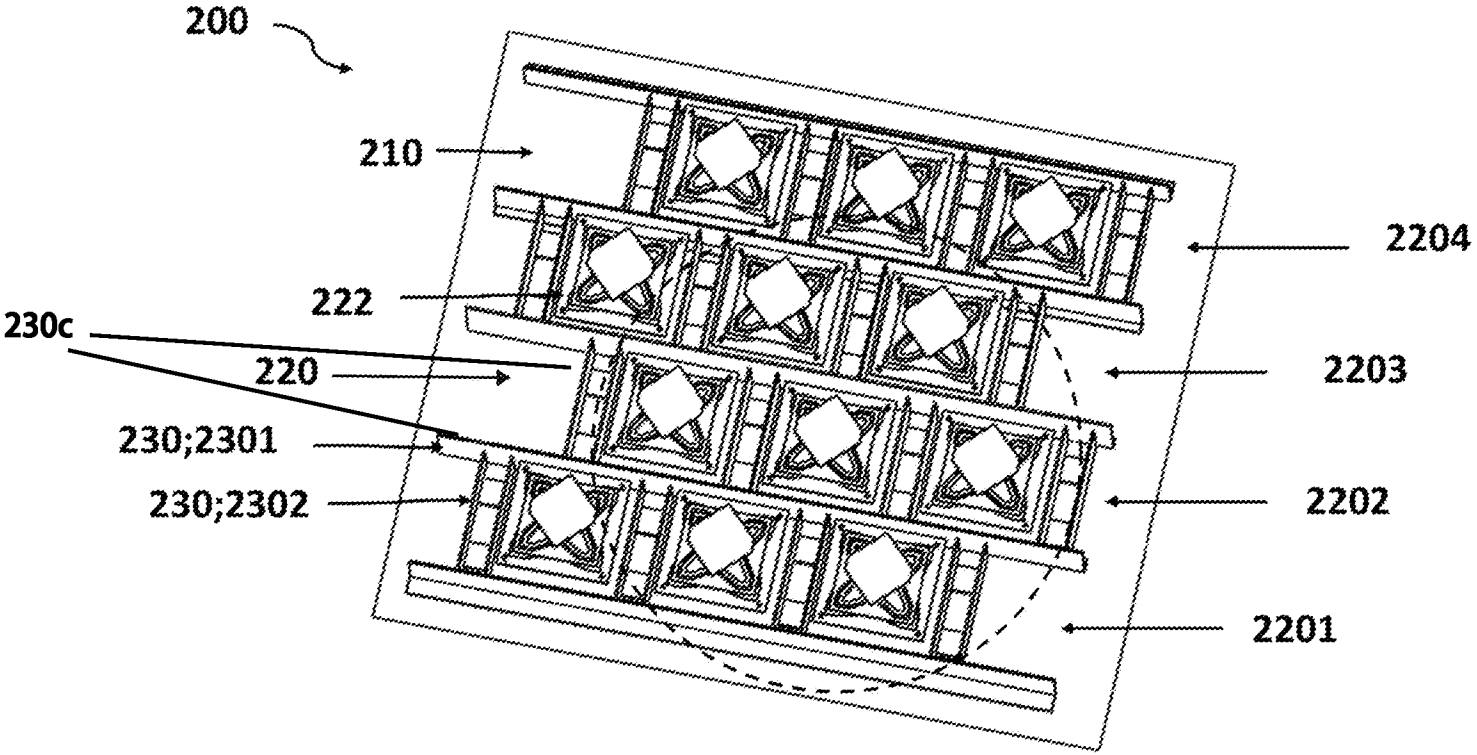
FIG. 2 is a schematic front view of an antenna assembly in the base station antenna of FIG. 1.

Referring to FIGS. 1 and 2, FIG. 1 is a schematic perspective view of a base station antenna according to some embodiments of the present invention, and FIG. 2 is a schematic front view of an antenna assembly in the base station antenna of FIG. 1.

As shown in FIG. 1, the base station antenna 100 is an elongated structure that extends along a longitudinal axis L. The base station antenna 100 may have a tubular shape with a generally rectangular cross-section. The base station antenna 100 includes a radome 110 and a top end cap 120. In some embodiments, the radome 110 and the top end cap 120 may comprise a single integral unit, which may be helpful for waterproofing the base station antenna 100. One or more mounting brackets 150 are provided on the rear side of the radome 110 which may be used to mount the base station antenna 100 onto an antenna mount (not shown) on, for example, an antenna tower. The base station antenna 100 also includes a bottom end cap 130 which includes a plurality of connectors 140 mounted therein. The base station antenna 100 is typically mounted in a vertical configuration (i.e., the longitudinal axis L may be generally perpendicular to a plane defined by the horizon when the base station antenna 100 is mounted for normal operation).

As shown in FIG. 2, the base station antenna 100 includes an antenna assembly 200 that may, for example, be slidably inserted into the radome 110 from either the top or bottom before the top cap 120 or bottom cap 130 is attached to the radome 110. The antenna assembly 200 includes a reflector 210 and arrays 220 of radiating elements 222 mounted on or above the reflector 210 in rows. The reflector 210 may be used as a ground plane for the radiating elements 222.

Further, parasitic elements 230 for the arrays 220 of radiating elements 222 may also be mounted on the reflector 210. The parasitic elements 230 may be, for example, conductive elements 230*c* that are mounted forwardly of the reflector 210 adjacent one or more of the radiating elements 222. The parasitic elements 230 may be configured to shape the radiation pattern of the one or more adjacent radiating elements 222. For example, parasitic elements 230 may be designed to narrow the beamwidth of the radiation pattern(s) of the one or more adjacent radiating elements 222 in the azimuth plane. In some cases, the parasitic elements 230 may comprise dipoles and may have lengths that are approximately the same length as dipoles that are included in the adjacent radiating elements 222. The parasitic elements 230 are not coupled to a feed network of the antenna that couples RF signals to and from the arrays 220 of radiating elements 222.

The parasitic elements 230 may be placed around the arrays 220 of radiating elements 222 or between adjacent radiating elements 222. Some of the parasitic elements 230 may be positioned to act as isolators between adjacent radiating elements 222 to increase the isolation and thereby reduce the coupling interference between the adjacent radiating elements 222. Other parasitic elements 230 may be placed around the arrays 220 of radiating elements 222 and may interact with the respective radiating elements 222. For example, in operation, the parasitic elements 230 may absorb radio waves emitted by the respective radiating elements 222 and then radiate the radio waves outward in different phases so as to favorably shape the resultant antenna beam by, for example, adjusting a beam width of the antenna beam.

The arrays 220 may be, for example, linear arrays of radiating elements 222 or two-dimensional arrays of radiating elements 222. In some embodiments, the arrays 220 of radiating elements 222 may extend substantially along the entire length of the base station antenna 100. In other embodiments, the arrays 220 of radiating elements 222 may extend only partially along the length of the base station antenna 100. The arrays 220 of radiating elements 222 may extend from a lower end portion to an upper end portion of the base station antenna 100 in a vertical direction V, which may be the direction of a longitudinal axis L of the base station antenna 100 or may be parallel to the longitudinal axis L. The vertical direction V is perpendicular to a horizontal direction H and a forward direction F (see FIG. 1). The radiating elements 222 may extend from the reflector 210 in the forward direction F.

In the present embodiment, only four linear arrays 220 of radiating elements 222 are exemplarily shown: a plurality of (exemplarily shown as three here) first radiating elements that are arranged as a first vertically extending array 2201; a plurality of (exemplarily shown as three here) second radiating elements that are arranged as a second vertically extending array 2202; a plurality of (exemplarily shown as three here) third radiating elements that are arranged as a third vertically extending array 2203; and a plurality of (exemplarily shown as three here) fourth radiating elements that are arranged as a fourth vertically extending array 2204. The four arrays are adjacent each other in the horizontal direction H.

In other embodiments, additional arrays 220 of radiating elements 222 (e.g., one or more arrays of high band radiating elements, one or more arrays of mid-band radiating elements and/or one or more arrays of low band radiating elements) may be mounted on the reflector 210. The low-band radiating elements 222 may, for example, operate in the 617 MHz to 960 MHz frequency band, or one or more portions thereof, the mid band radiating elements 222 may, for example, operate in the 1427 MHz to 2690 MHz frequency band, or one or more portions thereof, and the high band radiating elements 222 may, for example, operate in the 3 GHz or 5 GHz frequency bands, or one or more portions thereof.

Further, as the arrays 220 of radiating elements 222 are spaced more closely together to improve the electronic scanning capabilities of the antenna in the azimuth plane, the spacing between the radiating elements 222 is reduced. This reduced spacing degrades the isolation between radiating elements 222 in adjacent arrays 220, especially between radiating elements (e.g., dipoles) that have the same polarization (also referred to as Co-pol isolation). Thus, it may be necessary to improve the isolation between radiating elements 222 in adjacent arrays 220 in order to improve the beamforming performance of the base station antenna 100. For this purpose, adjacent arrays 220 of radiating elements 222 may be staggered with respect to each other, that is, the feed points of the radiating elements 222 in two adjacent arrays 220 are staggered in a vertical direction (i.e., not horizontally aligned with each other). This increases the spatial distance between radiators (e.g., dipole radiators) of adjacent radiating elements 222 that have the same polarization, thereby improving the isolation. In other embodiments, two adjacent arrays 220 of radiating elements 222 may also be vertically aligned with one another.

Pursuant to embodiments of the present invention, in order to improve the radiation pattern generated by the arrays 220 to, for example, improve the CPR performance, the radiating elements 222 are arranged on the reflector in a symmetrical, balanced layout in terms of an electromagnetic coupling environment such that the coupling interferences between adjacent radiating elements 222 may exhibit improved balance, thereby improving the shape of the radiation pattern. Next, a partial schematic view of the arrays 220 of radiating elements 222 and a schematic view of the arrays of parasitic elements 230 of the antenna assembly 200 in accordance with some embodiments of the present invention will be described in detail with reference to FIGS. 3 and 4.

Figure 3:
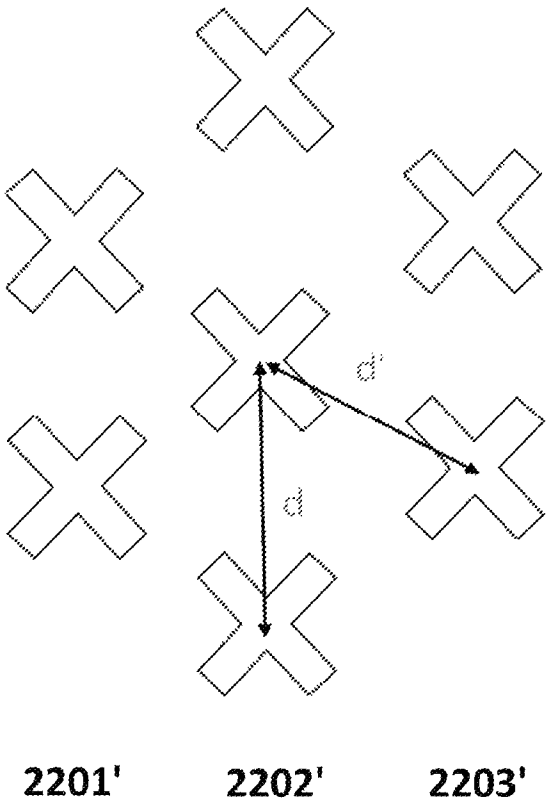
FIG. 3 is a partial schematic view of arrays of radiating elements of an antenna assembly according to some embodiments of the present invention.

FIG. 3 is a schematic front view of a portion of the antenna assembly 200 that is circled by dashed lines in FIG. 2. As shown in FIG. 3, the illustrated portion of the antenna assembly 200 includes a first sub-array 2201' that includes two first vertically arranged radiating elements 222; a second sub-array 2202' that includes three second vertically arranged radiating elements 222; and a third sub-array 2203' that includes two third vertically arranged radiating elements 222.

Two adjacent radiating elements 222 in each sub-array are spaced apart by a first spacing (d), while radiating elements 222 from adjacent arrays that are adjacent each other are spaced apart by a second spacing (d'). In the present embodiment, the first spacing d is substantially equal to a second spacing d'.

Thus, the radiating elements 222 in accordance with some embodiments of the present invention may be mounted on the reflector 210 to have a substantially symmetrical layout. The "symmetrical layout" may be appreciated as: the spacings between a radiating element and all the adjacent radiating elements are substantially equal, such that the coupling interferences of adjacent radiating elements on said radiating element are also presented in a symmetrical manner. In this regard, the radiating elements shown in FIG. 3 may collectively define a regular hexagonal topology. This can be seen, for example, with respect to the second radiating element in the middle of the second sub-array 2202' in FIG. 3. Such a symmetrical layout is advantageous in that: first, a relatively symmetrical coupling environment is created for the radiating elements 222, so that the coupling interferences of surrounding radiating elements 222, for example of adjacent radiating elements, are balanced with each other, which helps to improve the shape of the radiation pattern of the antenna; secondly, the spacing between adjacent arrays may be designed more closely to maintain the compactness of the antenna.

In some embodiments, the first spacings between two adjacent radiating elements 222 in a given sub-array may be slightly deviated from each other due to the manufacturing process, in this case the average value of the first spacings may be calculated to serve as a first average spacing. Likewise, the second spacings between two adjacent radiating elements 222 in two adjacent arrays 220 may also be slightly deviated from each other, and the average value of the second spacings may be calculated to serve as a second average spacing. In order to obtain a relatively symmetrical layout, the absolute value of the difference between the first average spacing minus the second average spacing may be less than 10%, 5%, 2% or 1% of the first or second average spacing in specific embodiments of the present invention.

Figure 4:
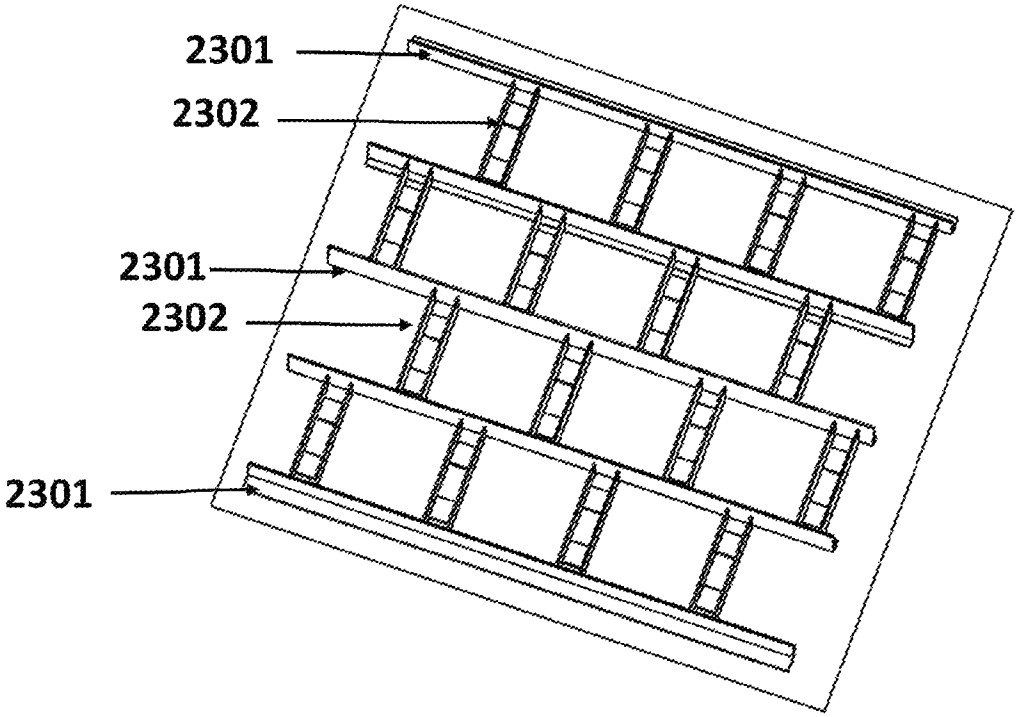
FIG. 4 is a schematic view of arrays of parasitic elements of an antenna assembly according to some embodiments of the present invention.

In order to further reduce the coupling interference and improve isolation between the arrays 220, in some embodiments of the invention, parasitic elements 230 may be provided around each radiating element 222. As shown in FIGS. 2 and 4, the antenna assembly 200 may include a plurality of first parasitic elements 2301 that extend in a vertical direction V. First parasitic elements 2301 may be disposed on both sides of each radiating element 222 of the array of radiating elements 220 in the horizontal direction. The antenna assembly 200 may also include a plurality of second parasitic elements 2302 that extend in the horizontal direction H. Second parasitic elements 2302 may be disposed on both sides of each radiating element 222 of the array of radiating elements 220 in the vertical direction. In other embodiments, the antenna assembly 200 may only include first parasitic elements 2301 or may only include second parasitic elements 2302. It should also be understood that the arrangement of the first and second parasitic elements 2301, 2302 shown in FIGS. 2 and 4 is only one example implementation, and that the number and arrangement thereof may vary as required.

The above-described arrangement of the first parasitic elements 2301 and the second parasitic elements 2302 is advantageous for several reasons. First, the first parasitic elements 2301 may reduce the coupling interference between adjacent arrays 220 and the second parasitic elements 2302 may reduce the coupling interference between adjacent radiating elements 222 in the same array 220, thereby further reducing the coupling interference effect on each radiating element 222. Second, parasitic elements are disposed not only on the left and right sides of each radiating element 222 but also on the upper and lower sides of each radiating element 222, thereby creating a relatively symmetrical isolation environment for each radiating element 222, which helps to improve the shape of the radiation pattern. Third, based on the enhanced isolation measures, the arrays 220 of radiating elements 222 may be spaced more closely together to maintain the compactness of the base station antenna 100.

The radiating elements 222, however, may be subjected to different intensities of coupling interference depending on their locations in front of the reflector 210. Typically, the radiating elements 222 in the middle region of the array formed by the four linear arrays 220 are subject to increased coupling interference from the surrounding radiating elements 222 as compared to the radiating elements 222 in the outer regions of the array. Pursuant to further embodiments of the present invention, different ones of the first parasitic elements 2301 and/or the second parasitic elements 2302 may be positioned at different distances forwardly of the reflector 210 (also referred to herein as "heights") based on an intensity of the respective coupling interference experienced by the radiating elements 222 based on their respective locations within the array. For example, the height of the first parasitic element 2301 and/or the second parasitic element 2302 may be stepped down one or more times from the middle region towards the outer region of the arrays 220 of radiating elements 222.

Figure 5:
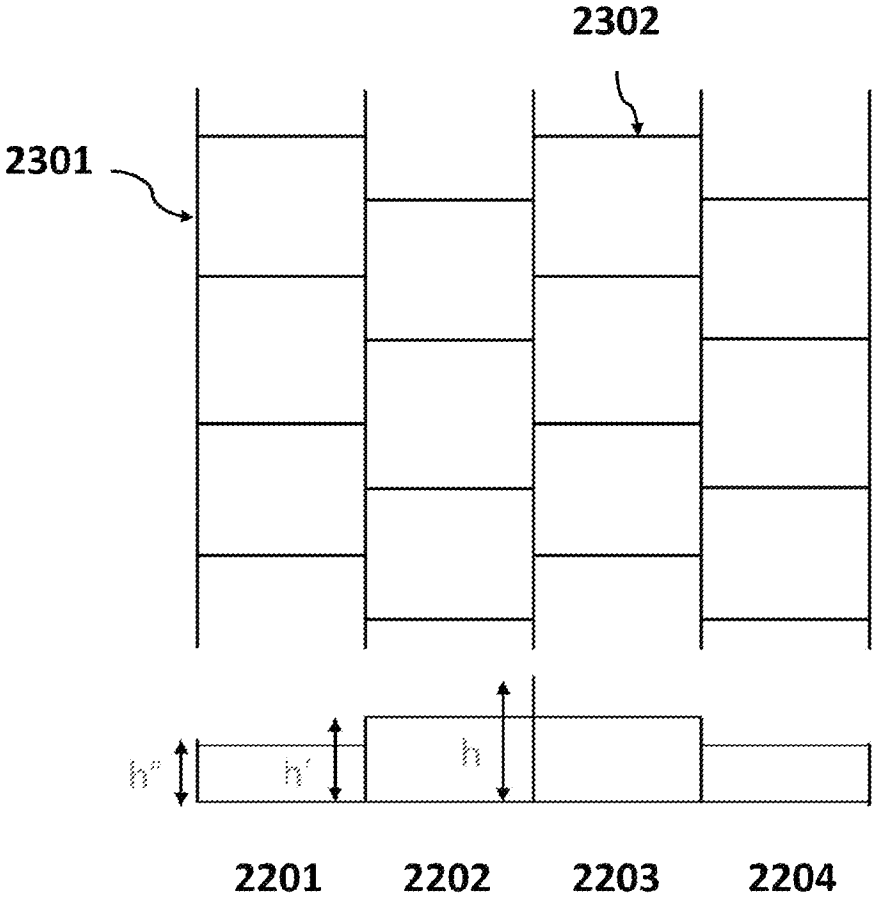
FIG. 5 is a simplified schematic view of arrays of parasitic elements of the antenna assembly in FIG. 4.

FIG. 5 is a simplified schematic view of the array of parasitic elements 230 in FIG. 4. In the simplified schematic view, the first parasitic element 2301 extends vertically from top to bottom, and the second parasitic element 2302 extends horizontally from left to right. As can be seen from the graph in the lower portion of FIG. 5, the first parasitic elements 2301 that extend between the middle two arrays 220 have a first height, the first parasitic elements 2301 that extend between each middle array 220 and a respective outer array have a second height that is less than the first height, and the first parasitic elements 2301 that extend along the outside edge of each outer array have a third height that is less than the second height. Thus, the heights of the first parasitic elements 2301 are stepped down two times from the middle region to the outer region of the array of radiating elements 222 (from h to h' and from h' to h"). In the present embodiment, a five columns of first parasitic elements 2301 are provided, where each column includes a total of five first parasitic elements 2301. For this purpose, first parasitic elements 2301 having three different heights may be provided, namely the first parasitic elements 2301 that are in the middle column have the largest height h (as the coupling interference from the surrounding radiating elements 222 is strongest in this region); the first parasitic elements 2301 in the outer columns edges have the smallest height h" (as the coupling interference from the surrounding radiating elements 222 is the weakest in this region); and the first parasitic elements 2301 in the remaining two columns have a height h' that is between heights h and h". Likewise, the height of the second parasitic elements 2302 may also be set in the same manner based on the intensity of coupling interference that occurs as a result of the positions the second parasitic elements within the array. It should also be understood that the specific structure and height of the first parasitic elements 2301 shown in FIG. 5 is only one example embodiment, and the specific arrangement thereof may vary as required.

Although exemplary embodiments of this disclosure have been described, those skilled in the art should appreciate that many variations and modifications are possible in the exemplary embodiments without materially departing from the spirit and scope of the present disclosure. Accordingly, all such variations and modifications are intended to be included within the scope of this disclosure as defined in the claims. The present disclosure is defined by the appended claims, and equivalents of these claims are also contained.

What is claimed is:

1. An antenna assembly for a beamforming antenna, comprising:

a reflector;

a first linear array of a plurality of first radiating elements, wherein the first linear array extends longitudinally and forwardly from the reflector;

a second linear array of a plurality of second radiating elements, wherein the second linear array extends longitudinally and forwardly from the reflector and is transversely spaced apart from the first linear array; and a first plurality of conductive elements positioned adjacent at least a first one of the plurality of first radiating elements, wherein at least one conductive element of the first plurality of conductive elements extends forwardly a further distance from the reflector than a different conductive element of the first plurality of conductive elements.

2. The antenna assembly of claim 1, wherein the at least a first one is a single first one, and wherein the first plurality of conductive elements comprise conductive elements that surround the single first one of the plurality of first radiating elements.

3. The antenna assembly of claim 1, further comprising a second plurality of conductive elements positioned adjacent at least a first one of the plurality of second radiating elements, wherein at least one conductive element of the second plurality of conductive elements extends forwardly a further distance from the reflector than a different conductive element of the second plurality of conductive elements.

4. The antenna assembly of claim 3, wherein the second first plurality of conductive elements comprise conductive elements that surround a single one of the plurality of second radiating elements.

5. The antenna assembly of claim 3, wherein each radiating element of the first and second linear arrays is surrounded by a respective subset of the first and/or second plurality of conductive elements.

6. The antenna assembly of claim 1, further comprising a second plurality of conductive elements positioned adjacent at least a second one of the plurality of first radiating elements, wherein at least one conductive element of the second plurality of conductive elements extends forwardly a further distance from the reflector than a different conductive element of the first plurality of conductive elements.

7. The antenna assembly of claim 6, wherein the at least one conductive element of the first plurality of conductive elements and the second plurality of conductive elements that extends forwardly a further distance from the reflector also extends forwardly of the at least a first one and the at least a second one of the corresponding first and second plurality of radiating elements.

8. The antenna assembly of claim 1, further comprising a third linear array of a plurality of third radiating elements and a fourth linear array of a plurality of fourth radiating elements, wherein the third linear array extends longitudinally and forwardly from the reflector and is transversely spaced apart from the first and second linear arrays and positioned closer to a right side of the reflector than the first and second linear arrays, and wherein the fourth linear array extends longitudinally and forwardly from the reflector and is transversely spaced apart from the first and second linear arrays and positioned closer to a left side of the reflector than the first, second and third linear arrays.

9. The antenna assembly of claim 1, wherein the first plurality of conductive elements comprise conductive elements that define parasitic elements.

10. The antenna assembly of claim 1, wherein the first plurality of conductive elements are sized and configured to reduce coupling between adjacent columns of the first and second linear arrays of radiating elements.

11. An antenna assembly for a beamforming antenna, comprising:

a reflector; and an antenna array that includes:

a plurality of first radiating elements that are arranged as a first array that is a vertically extending array, the first radiating elements extending forwardly from the reflector;

a plurality of second radiating elements that are arranged as a second array that is a vertically extending array, the second radiating elements extending forwardly from the reflector, wherein the second vertically extending array is laterally spaced apart from the first vertically extending array; and conductive elements that extend forwardly from the reflector and adjacent each of at least some of the first radiating elements and adjacent each of at least some of the second radiating elements, and wherein a subset of the conductive elements extend forwardly of the reflector a further distance than others of the conductive elements.

12. The antenna assembly according to claim 11, wherein the second radiating elements are staggered in a vertical direction with respect to the first radiating elements.

13. The antenna assembly according to claim 11, wherein at least some of the conductive elements are configured as parasitic elements that surround each first radiating element and each second radiating element.

14. The antenna assembly of claim 11, wherein the conductive elements comprise conductive elements that define box shapes that surround each respective first radiating element and each respective second radiating element.

15. The antenna assembly of claim 11, further comprising a plurality of third radiating elements that are arranged as a third vertically extending array, wherein the third vertically extending array extends longitudinally and forwardly from the reflector and is transversely spaced apart from the first and second vertically extending arrays and positioned closer to the right side or left side of the reflector than the first and second arrays.

16. A base station antenna having a beamforming array, comprising:

a reflector;

an antenna array that comprises a plurality of columns of radiating elements that extend forwardly from the reflector and conductive elements arranged as a plurality of columns positioned between respective pairs of adjacent columns of radiating elements, wherein a subset of the conductive elements extend forwardly from the reflector a further distance than others.

17. The base station antenna of claim 16, wherein the subset resides adjacent a right and/or left side of the reflector.

18. The base station antenna of claim 16, wherein the conductive elements comprise conductive elements arranged in box shapes that surround each of the radiating elements.

19. The base station antenna of claim 16, wherein the conductive elements comprise at least some conductive elements that are arranged in longitudinally spaced apart box shapes, with each box shape surrounding a respective one radiating element.

* * * * *